US005895029A

United States Patent [19]

Lacout

[11] Patent Number: 5,895,029

[45] Date of Patent: Apr. 20, 1999

[54] VALVE FOR A DEVICE FOR PACKAGING AND DISPENSING A SUBSTANCE STORED UNDER PRESSURE, A DEVICE FITTED THEREWITH, AND A METHOD OF MANUFACTURE

[75] Inventor: Franck Lacout, Athis Mons, France

[73] Assignee: L'Oreal, Paris, France

[21] Appl. No.: 08/644,061

[22] Filed: May 9, 1996

[30] Foreign Application Priority Data

May 11, 1995 [FR] France ..... 95 05575

[51] Int. Cl.[6] ..... B65D 83/14

[52] U.S. Cl. ..... 251/353; 251/354

[58] Field of Search ..... 251/353, 354

[56] References Cited

U.S. PATENT DOCUMENTS

| | | | |
|---|---|---|---|
| 3,248,015 | 4/1966 | De Giorgi | 251/353 |
| 3,613,964 | 10/1971 | Gronemeyer et al. . | |
| 3,618,833 | 11/1971 | Webster | 251/354 |
| 3,657,407 | 4/1972 | Gronemeyer et al. . | |
| 3,841,602 | 10/1974 | Mildern . | |
| 3,862,741 | 1/1975 | Steiman et al. | 251/353 |
| 4,743,422 | 5/1988 | Erling et al. . | |

FOREIGN PATENT DOCUMENTS

| | | |
|---|---|---|
| A 0 128 595 | 12/1984 | European Pat. Off. . |
| A 1111463 | 2/1956 | France . |
| A-1379202 | 4/1964 | France . |
| A 1379202 | 10/1964 | France . |
| A 2064449 | 7/1971 | France . |
| A 2099761 | 3/1973 | France . |

*Primary Examiner*—A. Michael Chambers
*Attorney, Agent, or Firm*—Oliff & Berridge, PLC

[57] ABSTRACT

A plastics material valve for a device for packaging and dispensing a substance. The valve comprises an actuator rod and a valve body, the actuator rod having a passage for passing the substance to be dispensed, the valve comprising closure means suitable for being held in the receptacle by the valve body and suitable for closing said passage, the actuator rod being capable of being displaced in the valve body between a first position in which said closure means close said passage and a second position in which said passage is released to enable the substance to be dispensed, the valve further comprising resilient return means for returning the actuator rod to said first position, the resilient return means comprising at least one bridge of material inter-connecting the actuator rod and the valve body and suitable for deforming elastically and for urging the actuator rod into said first position. The body, the actuator rod and said bridge of material being made by a dual-injection molding technique, the body and the rod being made of a first plastics material and the bridge of material being made of an elastomer, second plastics material, said plastics materials being selected in such a manner that said bridge of material is assembled to the rod and to the body by local melting of material during molding.

7 Claims, 1 Drawing Sheet

VALVE FOR A DEVICE FOR PACKAGING AND DISPENSING A SUBSTANCE STORED UNDER PRESSURE, A DEVICE FITTED THEREWITH, AND A METHOD OF MANUFACTURE

FIELD OF THE INVENTION

The present invention relates to devices for packaging and dispensing a substance, in particular a cosmetic, and more precisely the invention relates to a valve for fitting to a device that includes a receptacle suitable for containing the substance and for storing it under pressure. The valve is of the type having an actuator rod and a valve body. The actuator rod has a passage through which the substance to be dispensed passes. The valve includes closure means suitable for being held in the receptacle by the valve body and suitable for closing said passage, and the actuator rod can be displaced inside the valve body between a first position in which said closure means close said passage, and a second position in which said passage is released to enable the substance to be dispensed. The valve also has a resilient return means for returning the rod to said first position.

BACKGROUND OF THE INVENTION

Patent FR 2 035 669 proposes a valve of the above-specified type that includes inclined flexible fins integrally molded with the actuator rod and designed to exert a resilient return force urging the rod into a closure position. An advantage of that type of valve, which is made entirely out of plastics material, is the absence of any metal parts in contact with the substance to be dispensed.

OBJECTS AND SUMMARY OF THE INVENTION

An object of the invention is to further improve a valve of the above-specified type, in particular making it easier to mount the valve on the receptacle of the packaging and dispensing device.

The invention achieves this object by the fact that the resilient return means includes at least one bridge of material interconnecting the actuator rod and the valve body, suitable for deforming resiliently and suitable for urging the actuator rod into the first position, the valve body, the actuator rod, and the bridge of material being made by a dual-injection molding technique, the body and the rod being made of a first plastics material and the bridge of material being made of an elastomer, second plastics material, the plastics materials being selected in such a manner that the bridge of material can be assembled to the rod and the body by local melting of the material during molding.

The invention makes it possible to obtain a valve whose structure is relatively simple and compact, unlike known valves that are integrally molded using a single plastics material. The handling and installation of a valve of the invention in the receptacle of the packaging and dispensing device are made easier.

In an embodiment of the invention, the bridge of material has a portion of a disk fixed via a single face to the bottom end of the valve body and to the bottom end of the actuator rod. Advantageously, the disk includes openings between annular regions respectively in contact with the actuator rod and the valve body, and it is shaped so as to be pre-stressed when said actuator rod is in said first position.

In an embodiment of the invention, the valve body has an annular projection on its periphery suitable for being retained by crimping in the receptacle.

The invention also provides a method of manufacturing a valve as defined above, and a packaging and dispensing device fitted therewith.

BRIEF DESCRIPTION OF THE DRAWING

Other characteristics and advantages of the present invention appear on reading the following detailed description of a non-limiting embodiment of the invention, and on examining the accompanying drawing, in which.

MORE DETAILED DESCRIPTION

Figure 1:
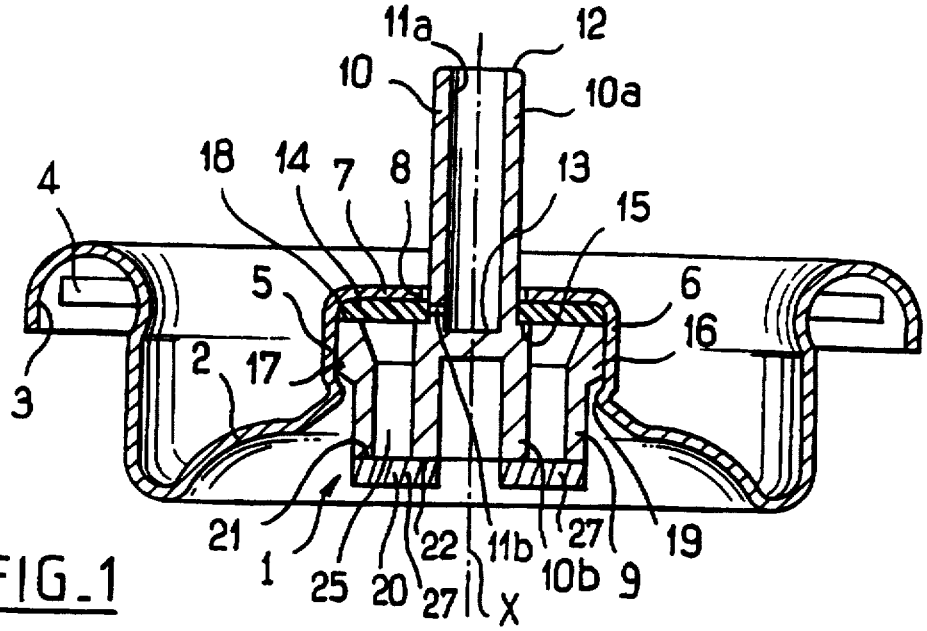
FIG. 1 is a diagrammatic axial section view of a valve constituting an embodiment of the invention, installed in a receptacle of a packaging and dispensing device.
Figure 2:
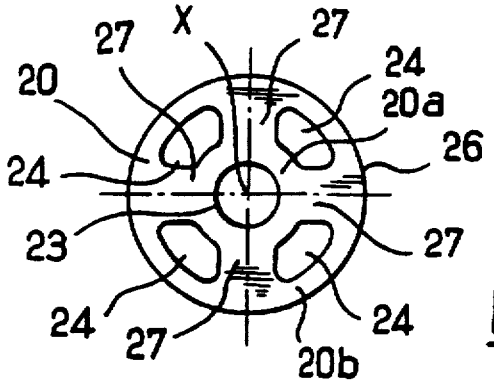
FIG. 2 shows in front view and in isolation the disk interconnecting the actuator rod and the valve body.
Figure 3:
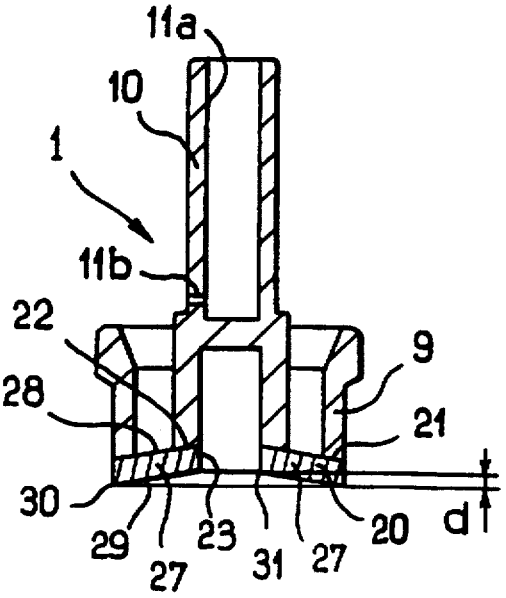
FIG. 3 is a diagrammatic axial section showing in isolation the valve body, the actuator rod, and the disk interconnecting them in the position in which they are molded.

The valve 1 of the invention as shown in FIGS. 1 to 3 is fitted to a receptacle of a packaging and dispensing device suitable for storing a cosmetic under pressure. The receptacle includes a conventional tubular body (not shown) that is elongate along a longitudinal axis X (lying in the section plane of FIG. 1) and that is closed at one end. The body is open at its opposite end and it receives a cap 2 that is also known per se. The cap 2 is for fixing on the body and has an annular groove 3 around its periphery for crimping on the open end edge of the body, which groove is provided internally with a sealing gasket 4. The center of the cap 2 has a housing 5 for receiving the valve 1. The housing 5 is radially defined by a wall 6 that is circularly cylindrical about the longitudinal axis X. This wall 6 is extended by a generally plane wall 7 that is perpendicular to the longitudinal axis X, and pierced in its center by a hole 8. The cap 2 may be cut and stamped from a metal disk.

The valve 1 has a valve body 9 and an actuator rod 10 capable of being displaced therein along the longitudinal axis X. The rod 10 passes through the hole 8 of the cap 2. A passage is formed along the rod 10 to convey the substance that is to be dispensed towards the outside. This passage is formed by uniting a blind bore **11*a* extending along the axis X and a through hole 11*b* extending radially. The bore 11*a* opens out in the end edge 12 of the rod 10 situated outside the receptacle. The hole 11*b* opens out at its radially inner end close to the bottom 12 of the bore 11*a*, and at its radially outer end, either to an annular sealing gasket 14, or else further down inside the receptacle, as specified below and depending on the position of the rod 10**.

The rod 10 has an outside shoulder 15 and reference **10*a* designates the rod portion situated to one side of the shoulder 15 that is engaged in the hole 8, while reference 10*b* designates the rod portion situated on the opposite side thereof and that extends inside the receptacle. A blind bore extending along the axis X is formed in the portion 10*b*** of the rod so as to avoid wasting material.

The above-mentioned gasket 14 presses against the wall 7 and its periphery is in contact with the wall 6. The gasket 14 is a tight fit around the portion **10*a* of the rod 10** so as to slide thereover in sealed manner.

The body 9 is generally in the form of a circularly symmetrical tube about the axis X. It is provided at one axial end with an annular rim 16 that projects radially outwards. The rim 16 is defined radially outwardly by a circularly cylindrical surface 17 about the axis X and situated in contact with the wall 6. The end edge 18 of the body 9 adjacent to the rim 16 bears against the gasket 14 which it holds pressed against the wall 7. The body 9 is retained in the housing 5 by crimping. More precisely, its section is narrowed at 19 where the wall 6 joins the remainder of the cap 2 so as to oppose radial displacement of the rim 16 in the housing 5 after the body 9 has been mounted in the cap 2.

A disk 20 of elastomer material connects the body 9 to the rod 10. The same face of this disk 20 is fixed both to the bottom end edge 21 of the body 9 remote from the rim 16 and to the bottom end edge 22 of the rod 10 remote from its end edge 12.

FIG. 2 shows the disk 20 in isolation. The disk is axially symmetrical about an axis that coincides with the axis X in the example described. A central hole 23 passes through it on the axis. Four openings 24 that are uniformly spaced apart angularly around the axis X are provided through the thickness of the disk to cause the annular space 25 situated between the body 9 and the portion **10*b* of the rod 10 to communicate with the inside space of the receptacle that contains the substance. Each opening 24 occupies an angular sector occupying an angle at its apex on the axis X which is equal to about 50°, and is radially defined by two circularly arcuate edges centered on the axis X and interconnected by two generally rectilinear edges that are perpendicular thereto. The end edge 22 of the portion 10*b* of the rod 10 is fixed to the annular region 20*a* of the disk 20, extending radially between the edges of the hole 23 and the radially inner circular arcuate edges of the openings 24. The end edge 21 of the body 9 is fixed in the annular region 20*b* of the disk 20, extending radially between the periphery 26 thereof and the radially outer circularly arcuate edges of the openings 24. The actuator rod 10 and the valve body 9 are thus interconnected by four bridges of material 27 that extend radially over the disk 20 between the openings 24. The valve body 9, the actuator rod 10, and the disk 20** thus form a single part which is made by a dual-injection plastics molding technique.

It will be observed that the shapes of the valve body, of the actuator rod 10, and of the disk 20 are relatively simple, thereby facilitating manufacture of the tooling used for making the valve.

More precisely, the body 9 and the rod 10 are made initially in the cavity of a mold having a sliding core by injecting a first plastics material that is relatively rigid. Thereafter, the core of the mold is moved and a second plastics or elastomer material is injected into the gap left by moving the core, thereby forming the disk 20. A plastics or elastomer material is selected that is compatible with the first plastics material so that the disk 20 is assembled to the body 9 and to the rod 10 by local melting during injection. In the example described, the body 9 and the rod 10 are made of polypropylene and the disk 20 is made of an elastomer material known under the name "santoprene".

The body 9, the rod 10, and the disk 20 are molded in the disposition shown in FIG. 3, with the end edge 22 of the rod 10 being slightly set back from the end edge 21 of the body 9. The disk 20 is generally curved in shape with its concave face directed away from the actuator rod 10. The face 28 of the disk 20 that is in contact with the body 9 and the actuator rod 10 is thus conical and parallel to its opposite face 29. The plane containing the peripheral edge 30 of the face 29 and the plane containing the edge 31 of the hole 23 situated in the face 29 are offset through a distance d along the axis X. When the valve body 9 is assembled in the housing 5, the rod 10 moves down through said distance d towards the inside of the receptacle and the disk 20 deforms elastically. It is thus pre-stressed and holds the shoulder 15 pressed against the gasket 14 to seal the receptacle hermetically.

The valve 1 operates as follows. The packaging and dispensing device is used with the cap 2 at the bottom, i.e. in a position which is upside-down relative to the position shown in FIG. 1. At rest, the actuator rod 10 is urged by the disk 20 into the closed position, with the shoulder 15 coming into axial abutment against the gasket 14 as explained above. The orifice **11*b* then opens out into the thickness of the gasket 14 and is therefore closed thereby. In this position of the rod 10, the faces 28 and 29 of the disk 20** extend generally perpendicularly to the longitudinal axis X.

When the user presses on the actuator rod 10 (indirectly via a pushbutton that forms a nozzle and that is mounted in conventional manner on the portion **10*a* of the rod, and that is not shown), the orifice 11*b* opens out into the space 25 inside the receptacle and enables the substance to flow out as expelled from the receptacle by the pressure of a propellant gas. The disk 20 is deformed elastically during this action of the user. When the user releases the pushbutton, the disk 20 returns to its initial shape, thereby returning the actuator rod 10 to its rest position which corresponds to the orifice 11*b* being closed by the gasket 14. The resilient return force exerted by the disk 20 is proportional to the displacement of the disk 10** towards the inside of the receptacle.

Naturally, various modifications can be applied to the valve described above without going beyond the ambit of the invention, in particular, the valve body 9 may be associated with a dip tube enabling the device to be used with the cap 2 on top. In a variant, an additional gas inlet can be provided in the valve body 9 so as to dispense the substance (hair spray, deodorant, . . . ) in the form of a fine spray.

I claim:

1. A valve of plastics material for a device for packaging and dispensing a substance, the device comprising a receptacle suitable for containing said substance and for storing it under pressure, the valve comprising an actuator rod and a valve body, the actuator rod having a passage for passing the substance to be dispensed, the valve comprising closure means suitable for being held inside the receptacle by the valve body and suitable for closing said passage, the actuator rod being capable of being displaced in the valve body between a first position in which said closure means close said passage and a second position in which said passage is released to enable the substance to be dispensed, the valve further comprising resilient return means for returning the actuator rod to said first position, said resilient return means comprising at least one bridge of material interconnecting the actuator rod and the valve body, suitable for deforming resiliently and suitable for urging the actuator rod into said first position, wherein the body, the actuator rod and the bridge of material together comprise a single integral dual-injection molded part, the body and the rod being made of a first plastics material and the bridge of material being made of an elastomer, second plastics material.

2. A valve according to claim 1, wherein said bridge of material is constituted by a portion of a disk having one of its faces fixed to a bottom end of the body and to the bottom end of the actuator rod.

3. A valve according to claim 2, wherein said disk includes openings between annular regions of the disk hat are respectively in contact with the rod and with the body.

4. A valve according to claim 2, wherein the disk is shaped in such a manner as to be pre-stressed when said actuator rod is in said first position.

5. A valve according to claim 1, wherein the valve body has an annular rim on its periphery suitable for being retained by crimping in the receptacle.

6. A valve according to claim 1, wherein said passage formed in the actuator rod is formed by uniting a blind bore opening out to the free end of the rod situated outside the receptacle, and by a through hole extending radially and opening out close to the end of the blind bore, said through hole being situated in the rod in such a manner to be closed by a sealing gasket constituting said closure means when the rod is in said first position, and suitable for being offset from said gasket when the rod is in the said second position.

7. A device for packaging and dispensing a substance, the device comprising a receptacle suitable for containing said substance stored under pressure, and fitted with a valve as defined in claim 1.

* * * * *